US005702329A

United States Patent [19]

Koenig

[11] Patent Number: 5,702,329

[45] Date of Patent: *Dec. 30, 1997

[54] EXERCISE APPARATUS

[75] Inventor: Larry Koenig, Williamsburg, Iowa

[73] Assignee: Jam'n Fitness Corp., Williamsburg, Iowa

[ * ] Notice: The term of this patent shall not extend beyond the expiration date of Pat. No. 5,529,558.

[21] Appl. No.: 621,291

[22] Filed: Mar. 21, 1996

Related U.S. Application Data

[63] Continuation of Ser. No. 475,355, Jun. 7, 1995, Pat. No. 5,529,558.

[51] Int. Cl.[6] ..... A63B 21/06

[52] U.S. Cl. ..... 482/97; 482/98; 482/137

[58] Field of Search ..... 482/97, 100, 98, 482/101, 135, 137, 92–94, 104, 133, 136, 142

[56] References Cited

U.S. PATENT DOCUMENTS

| | | | |
|---|---|---|---|
| Re. 31,170 | 3/1983 | Mazman . | |
| 4,236,712 | 12/1980 | Lambert, Jr. . | |
| 4,357,010 | 11/1982 | Telle . | |
| 4,357,011 | 11/1982 | Voris . | |
| 4,456,246 | 6/1984 | Szabo | 482/98 |
| 4,872,668 | 10/1989 | McGillis et al. | 482/113 |
| 4,872,670 | 10/1989 | Nichols . | |
| 4,974,835 | 12/1990 | Klink | 482/97 |
| 5,108,095 | 4/1992 | Nichols . | |
| 5,116,297 | 5/1992 | Stonecipher . | |
| 5,284,465 | 2/1994 | Homan, Jr. . | |
| 5,336,148 | 8/1994 | Ish, III . | |
| 5,529,558 | 6/1996 | Koenig | 482/97 |
| 5,605,523 | 2/1997 | Ish, III et al. | 482/97 |
| 5,626,548 | 5/1997 | Coyle | 482/95 |

*Primary Examiner*—Richard J. Apley
*Assistant Examiner*—Victor K. Hwang
*Attorney, Agent, or Firm*—Allan L. Harms

[57] ABSTRACT

Exercise apparatus for strengthening the legs and hips of a user. A weight carrying pivot arm rides up and down a pivotable mast when the user squats and rises, causing the resistance of the apparatus to increase as the user approaches a standing position. An optional toe plate may be added to allow exercise of ankle and foot structures.

20 Claims, 7 Drawing Sheets

EXERCISE APPARATUS

This application is a continuation of application Ser. No. 08/475,355, filed Jun. 7, 1995, now U.S. Pat. No. 5,529,558.

BACKGROUND OF THE INVENTION

In the field of body exercise and strength training, there is a need to exercise the lower extremities under a resistive load. Various exercises have been devised to strengthen hip and leg muscles of the body through squatting exercises and leg lifting exercises. To increase the exercise level, the person performing the exercise may carry weights on the shoulders while doing squatting exercises. However, squatting exercises place great stress on knee joints, ligaments, and tendons, and can lead to injury if not performed properly and with care. In addition, the use of carried weights to further load the musculature presents the problem of reduced stability with a raised center of gravity which occurs when a barbell is placed on the shoulders.

Some exercise machines have been devised to facilitate exercise of leg muscles under load. The known devices fail to vary the load between stages in the exercise when the body is weaker such as at the bottom of a squat maneuver. A need exists for an exercise machine which can be safely used to effectively resist the action of the lower extremity muscles and thereby to provide strengthening while providing a load which varies between positions during the exercise.

Also, in the field of body exercise and strength training, there is a need to exercise the upper extremities under a resistive load. Various exercises have been devised to strengthen arm and shoulder muscles of the body through lifting exercises, including pressing a barbell from a sitting position, or pressing up on a lever which lifts adjustable weights which are specially made for the specific exercise machinery. However, the use of a barbell with weights carries with it the danger of losing one's balance while the use of available exercise machinery does not vary the resistance as the body's ability to overcome resistance increases. The known devices fail to vary the load between stages in the exercise when the body is weaker such as when the elbows are fully bent. A need exists for an exercise machine which can be safely used to effectively resist the action of the upper extremity muscles and thereby to provide strengthening while providing a load which varies between positions during the exercise.

SUMMARY OF THE INVENTION

The present invention relates to exercise machines and in particular to apparatus to allow an athlete to increase lower body strength. A supporting frame is provided with an inclined foot plate on which the user stands. A vertical arm extends from the frame at a distance from the foot plate. A pivot arm is pivotally mounted at the top of the vertical arm, the pivot arm being pivotable in a vertical direction. An upright mast is pivotably fixed to the frame near the foot plate, and movable in a plane in which the pivot arm moves. The pivot arm is provided with a pivotable head member on its free end, the head member being slidable along the mast and having a locking plug which can be selectively entered into one of a plurality of openings along the mast in order to retain it in a fixed vertical position when the user is becoming stationed on the machine. The head member further is provided with a pair of shoulder rests which extend from the head member and have a space between them such that the rests can touch the shoulders of the user with the user's head placed between the rests. Handholds also depend outwardly and downwardly from the head member to provide grips for the hands of the user in a comfortable, natural position.

The pivot arm is provided with a weight suspending bar which depends from a point along the pivot arm at an angle of approximately 65 degrees. The weight suspending bar has a transverse weight arm at its free end on which free weights of the common type can be suspended.

The foot plate of the frame is inclined downwardly from the outside of the frame toward the mast pivot so that the user will be prompted to lean forward slightly when using the apparatus.

The locking plug of the head can be disengaged from the mast to allow the head member to be alternately lowered and raised as it slides along the mast. As the user lowers the trunk of his or her body, the force exerted by the weights on the transverse weight arm is increased as the user pushes the head upwardly along the mast. Hence the resistance increases as the natural strength of the user increase as the user returns to a standing position.

An optional toe plate may be stationed over the foot plate near or at the outer edge of the frame. The toe plate is shaped to provide an inclined surface on which the user may place the forward part of his or her feet. The slope of the surface is inclined upward toward the mast. The toe plate allows the user to exercise lower leg and foot muscles by relaxing the heel onto the surface of the toe plate and then positioning the shoulder rests on the user's shoulders and then forcing the head member upward on the mast as the heels are raised from the surface of the toe plate.

The present invention also relates to apparatus useful to an athlete to increase upper body strength. A supporting base is provided with a seat on which the user rests. The seat is supported on a shaft and is adjustable in height above the base. An angled arm extends above the base at a distance from the seat. A pivot arm is pivotally mounted at the top of the arm, the pivot arm being pivotable in a vertical direction. A coil spring is interconnected between the pivot arm and a bracket fixed to the angled arm such that the weight of the pivot arm is counterbalanced. Specifically the pivot arm extends past its pivot on the angled arm and the free end of the extension is attached to one end of the coil spring and the other end of the spring is fixed to the angled arm along its length, such that the coil spring is in tension when the pivot arm is in a lowered position.

An upright mast is pivotably fixed to the frame between the seat and the arm, and is movable in the plane in which the pivot arm moves. The pivot arm is provided with a pivotable head member on its free end, the head member being slidable along the mast and having a lowermost rest position where the head member engages a stop element fixed to the mast. The head member is provided with a generally upstanding bar from which extend handlebars to provide grips for the hands of the user in a comfortable, natural position. The handlebars are extended such that the user may grip the handlebars in varying distances from the upstanding arm.

The pivot arm is provided with a weight suspending bar which depends from the lower surface of the pivot arm, the weight suspending bar having a transverse weight arm at its free end.

It is an object of the invention to provide an exercise apparatus to build leg and hip strength of a user.

It is another object of the invention to provide an upper extremity exercise apparatus which increases in resistance as the arms are extended.

It is a further object of the invention to provide an arm strengthening apparatus which causes the user to press a load in an upward direction in a controlled manner with the force required to press the load increasing as the load is pressed higher.

It is a further object of the invention to provide a leg strengthening apparatus which causes the user to perform exercises at the minimal risk of injury to the ligaments, tendons and joints in the legs and knees.

It is a further object of the invention to provide exercise apparatus to strengthen hip and leg muscles which distributes the weight to the user's body in a safe and efficient manner.

It is a further object of the invention to provide exercise apparatus which increases the resistive force of the apparatus as the position of the user changes to a stronger position.

It is a further object of the invention to provide an exercise apparatus which is variable in application of force to the user through use of readily available free weights.

It is a further object of the invention to provide an exercise apparatus which may be adjusted for differing sizes and strengths of athlete users.

It is a further object of the invention to provide means for an athlete to perform squatting exercises with weights without losing stability and without the need for a spotter.

These and other objects of the invention will become apparent from examination of the description and claims which follow.

DESCRIPTION OF THE DRAWING FIGURES

DETAILED DESCRIPTION OF THE INVENTION

Figure 1:
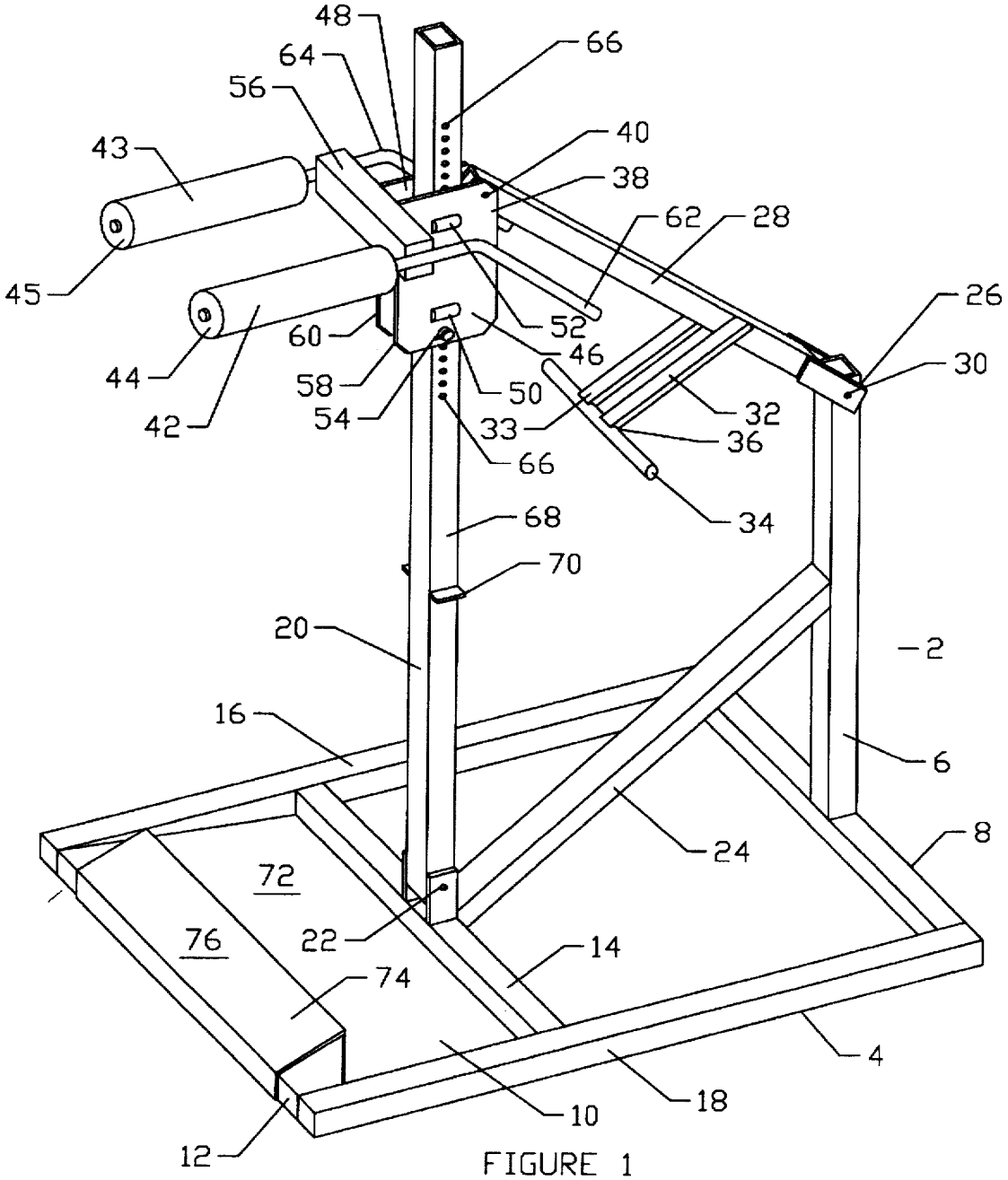
FIG. 1 is a front left perspective of the invention in a locked position with the head and pivot arm midway along the mast.

Referring to the drawings, FIG. 1 illustrates the Invention 2 in a front left perspective view. Invention 2 is provided with a base frame 4 from which upwardly extends a support arm 6 which is located at second end 8 of frame 4. Frame 4 supports a foot plate 10 which is located adjacent first end 12 of frame 4. A beam 14 extends from first side 16 to second side 18 of frame 4 and provides a support member for mast 20 which is pivotally mounted to beam 14 of frame 4 at pivot 22. The axis of mast 20 is coplanar with the axis of support arm 6 and mast 20 is movable relative to its pivot 22 in this plane. A brace 24 is conveniently interconnected between beam 14 and support arm 6 for stability of support arm 6.

At upper end 26 of support arm 6 is pivotably mounted a pivot arm 28 which is movable vertically about pivot pin 30 in the plane common to the axes of mast 20 and support arm 6. Depending from pivot arm 28 along its length are weight support arms 32, 33 which are provided with transverse rod 34 at the free end 36 of weight support arm 32, 33. Weight support arms 32, 33 extend downwardly from pivot arm 28 and toward mast 20. In the preferred embodiment, weight support arms 32 and 33 are paired and fixedly mounted to opposing sides of pivot arm 28 such that each is generally coplanar with mast 20. Weight arms 32 and 33 may be substituted by a single arm fixed to pivot arm 28.

The pivot arm 28 is provided with a head member 38 which is pivotably movable upon pivot arm 28 about axle 40 and is fashioned to ride up and down along mast 20.

Shoulder rests 42, 43 depend generally horizontally from head member 38 to overlie foot plate 10 and are spaced apart sufficiently to allow a user to position his or her head between shoulder rests 42 and 43. Shoulder rests 42 and 43 are provided with cushions 44, 45 which are of suitable resilient material, e.g. foam rubber, to reduce abrading which might occur when the user's shoulders are in engagement with shoulder rests 42 and 43. In the preferred embodiment, head member 38 comprises first and second plates 46 and 48 which are spaced apart and parallel and disposed on opposing sides of mast 20. Guide rollers 50 and 52 are mounted in plate 46 to engage mast 20. Similar rollers are mounted to plate 48. A lock 54 is located upon first plate 46.

A transverse bar 56 is mounted to front edges 58 and 60 of plates 46 and 48 respectively to serve as a mounting for shoulder rests 42 and 44. Also depending from bar 56 are hand holds 62 and 64, which extend outward and downward from head member 38 on opposing sides thereof to provide a place for the user to hold the device.

Mast 20 is constructed of a hollow rolled steel bar and has a plurality of vertically spaced openings 66 on first side 68 of mast 20 along the upper end thereof. Openings 66 are provided to interact with lock 54 to selectively retain head member 38 in alternative selected locations along mast 20 when desired. A stop 70 is mounted to the first side 68 of mast 20 to provide a lowermost position for head member 38, thereby providing a safety feature to prevent head member from being slideable along mast 20 below a fixed vertical location.

Foot plate 10 is mounted to frame 4 such that the top surface 72 of foot plate 10 declines from first end 12 of frame 4 to beam 14.

FIG. 1 illustrates the invention 2 with optional toe plate 74 installed. Toe plate 74 is optionally placed to overlie the region of foot plate 10 adjacent first end 12 of frame 4 and provides a top surface 76 which inclines from first end 12 of frame 4 toward mast 20.

It can be seen that the preferred embodiment device provides a device with mast 20 and support arm 6 extending above frame 4 at generally the midline thereof.

Figure 2:
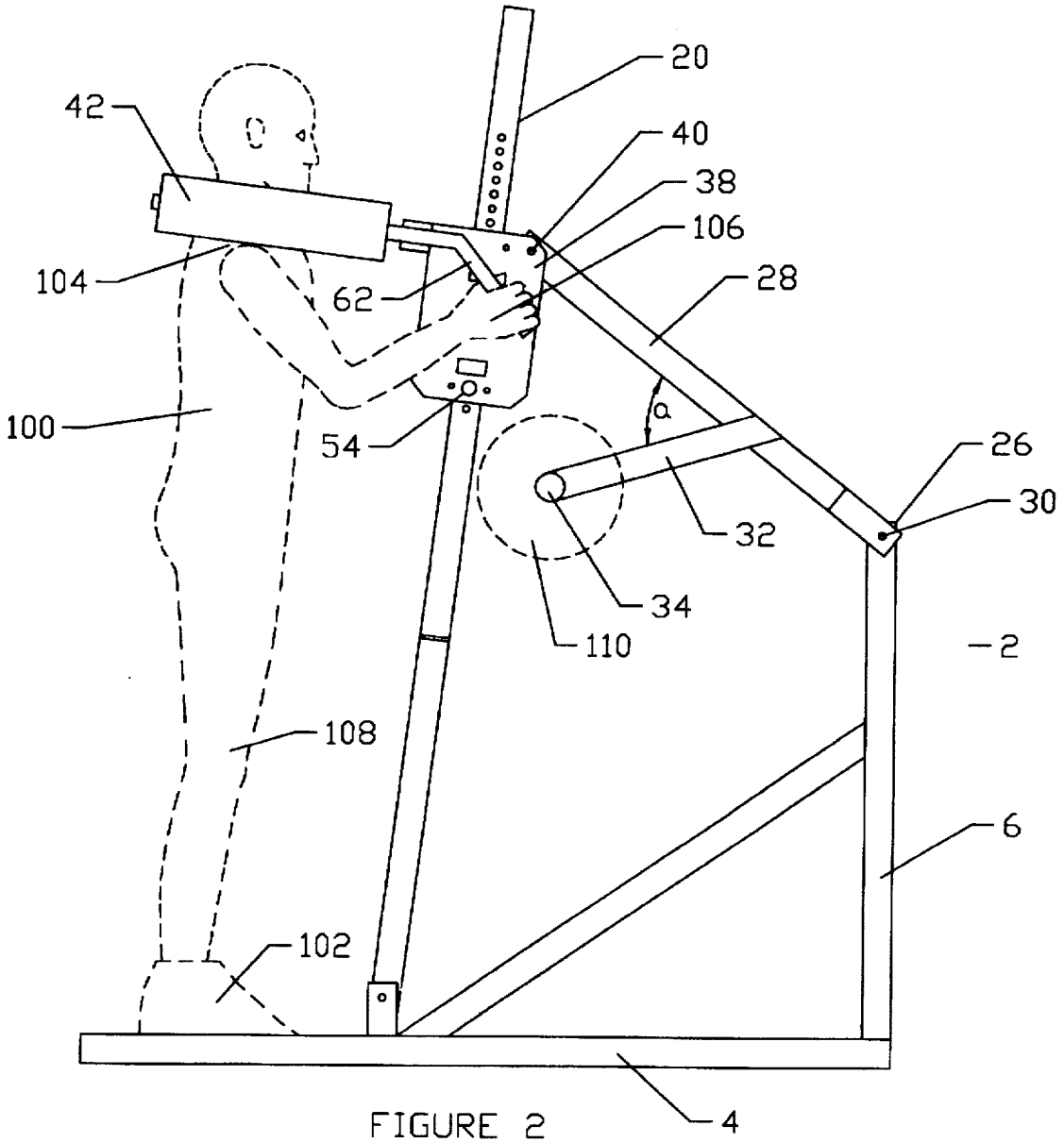
FIG. 2 is a front elevation of the invention with a user in phantom shown in position to commence use of the invention.

Referring now to FIG. 2, a user 100 is shown in phantom in position to use invention 2. User's feet 102 are situated on foot plate 10 of the preferred embodiment device. The optional toe plate 74 has been removed. In a standing position, user 100 has released lock 54 which allows head member 38 to follow mast 20 to a point where shoulder rest 42 rests upon the user's shoulder 104. The right hand 106 of user 100 is shown grasping hand hold 62. With user 100 in a standing position with legs 108 extended, head member 38 is disposed at a first relatively higher position along mast 20. Head member 38 has pivoted about axle 40 and pivot arm 28 has pivoted about pin 30 on upper end 26 of support arm 6 such that shoulder rests 42 and 43 remain generally horizontal and rest on user's shoulder 104. Weight support arm 32 is shown with free weight 110 (shown in phantom) mounted on transverse rod 34. Weight support arm 32 is mounted to pivot arm 28 at an acute angle a which is preferably 65±5 degrees. It can be seen that as pivot arm 28 is rotated about upper end 26 of support arm 6 in an upward direction, transverse rod 34 is moved upward and closer to mast 20, thereby increasing the effective moment arm of free weights 110 about pivot pin 30.

Figure 3:
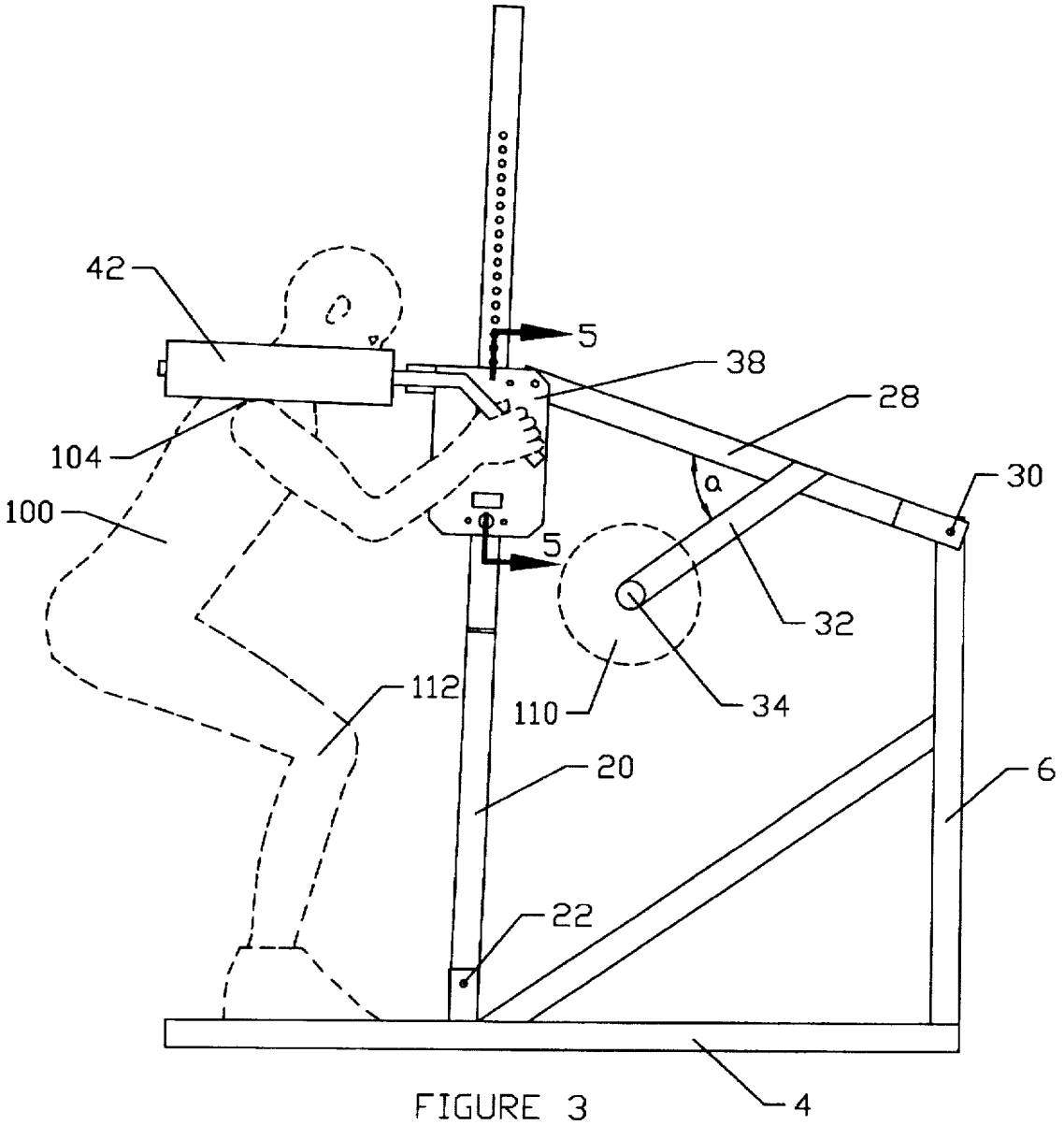
FIG. 3 is a front elevation of the invention in a second position showing a user in phantom in a squat position while using the invention.

FIG. 3 discloses the invention 2 in a second position thereof when user 100 has squatted, thereby bending user's knees 112. As the user 100 squats, shoulder rest 42 follows user's shoulder 104 as it declines and head member 38, having lock 54 released, is permitted to follow mast 20 in a downward path. As head member 38 follows mast 20, mast 20 rotates about pivot 22 toward user 100 and pivot arm 28 is lowered about pivot pin 30. Weight support arm 32 and transverse rod 34 also are lowered and the placement of weight 110 is moved in an arc toward support arm 6 and away from mast 20, thereby reducing the moment of weight 110 about pivot pin 30 and reducing the lifting force needed to be exerted by user 100 on shoulder rest 42. The action of invention 2 can be seen to provide effective, safe resistive force to user 100 with the force declining as the user 100 squats into a relatively weaker position and with the resistive force increasing as the user 100 extends his or her legs 108 into a standing position.

Figure 4:
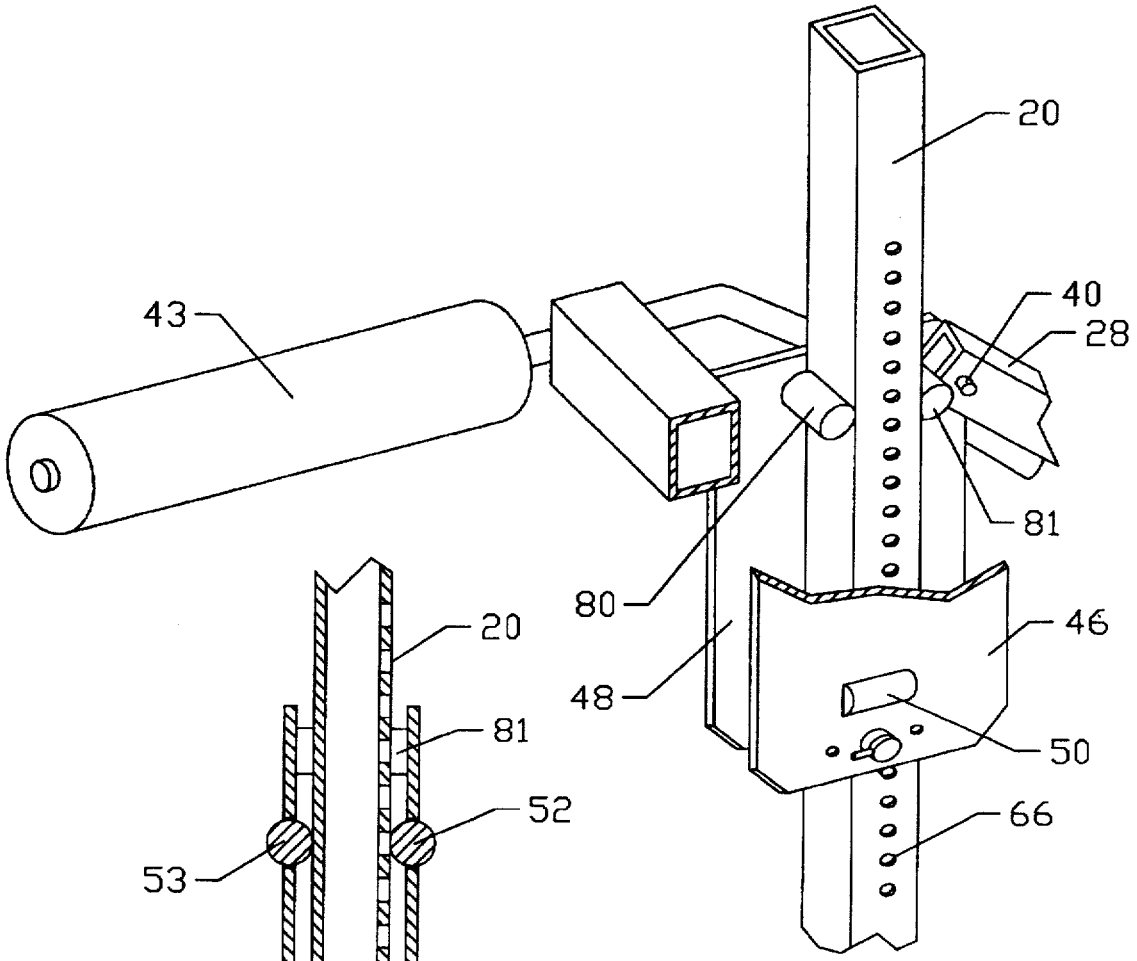
FIG. 4 is a partly cut away perspective view of the head member of the pivot arm showing its component parts and their engagement with the mast of the invention.
Figure 5:
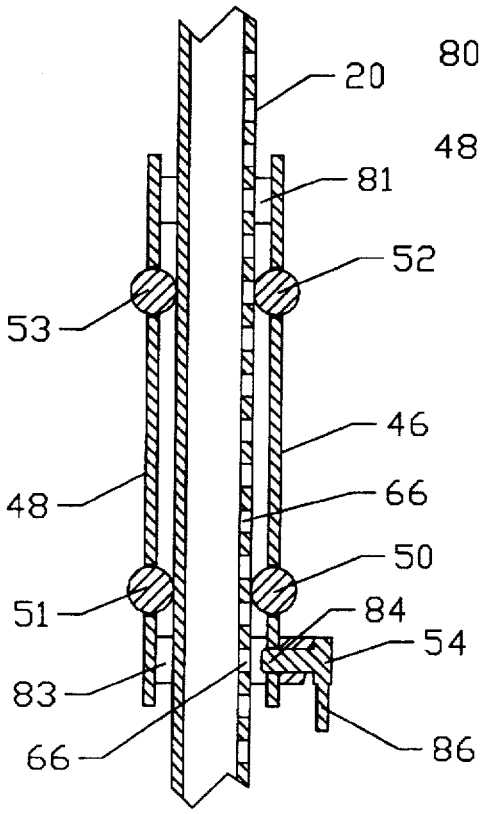
FIG. 5 is a cross section of the mast and head of the invention taken along line 5—5 of FIG. 3.

Referring now to FIGS. 4 and 5, the detail of the structure of head member 38 can better be visualized. FIG. 4 provides a partly cut away front left perspective of the head member 38 and mast 20 showing left shoulder rest 43 depending generally horizontally from head member 38. Head member 38 comprises first plate 48 and second plate 46 which are maintained in spaced apart relationship on opposing sides of mast 20 by thrust bearings 80 and 81 which roll along the front and rear of mast 20 as head member 38 traverses mast 20. Guide bearing 50 is mounted within second plate 46 and rolls along first side 68 of mast 20. Lock 54 is mounted within second plate 46.

Referring now to FIG. 5, the head member 38 and mast 20 are shown in section taken along line 5—5 of FIG. 3. First plate 48 of head member 38 has guide bearings 51 and 53 mounted thereto, which roll along the lateral sides of mast 20. Thrust bearings 81 and 83 serve to space first and second plates 48 and 46 and to provide roller bearing upon rear face of mast 20. Lock 54 is shown in an unlocked state in FIG. 3 with plunger 84 thereof displaced from any of openings 66 of mast 20. Lock handle 86 is moved to an unlocked position where plunger 84 is locked in a position displaced from mast 20. When lock handle 86 is moved, spring biasing of plunger 84 causes plunger 84 to be urged toward mast 20 and to locate in an opening 66 as one of openings 66 comes into alignment with plunger 84.

Figure 6:
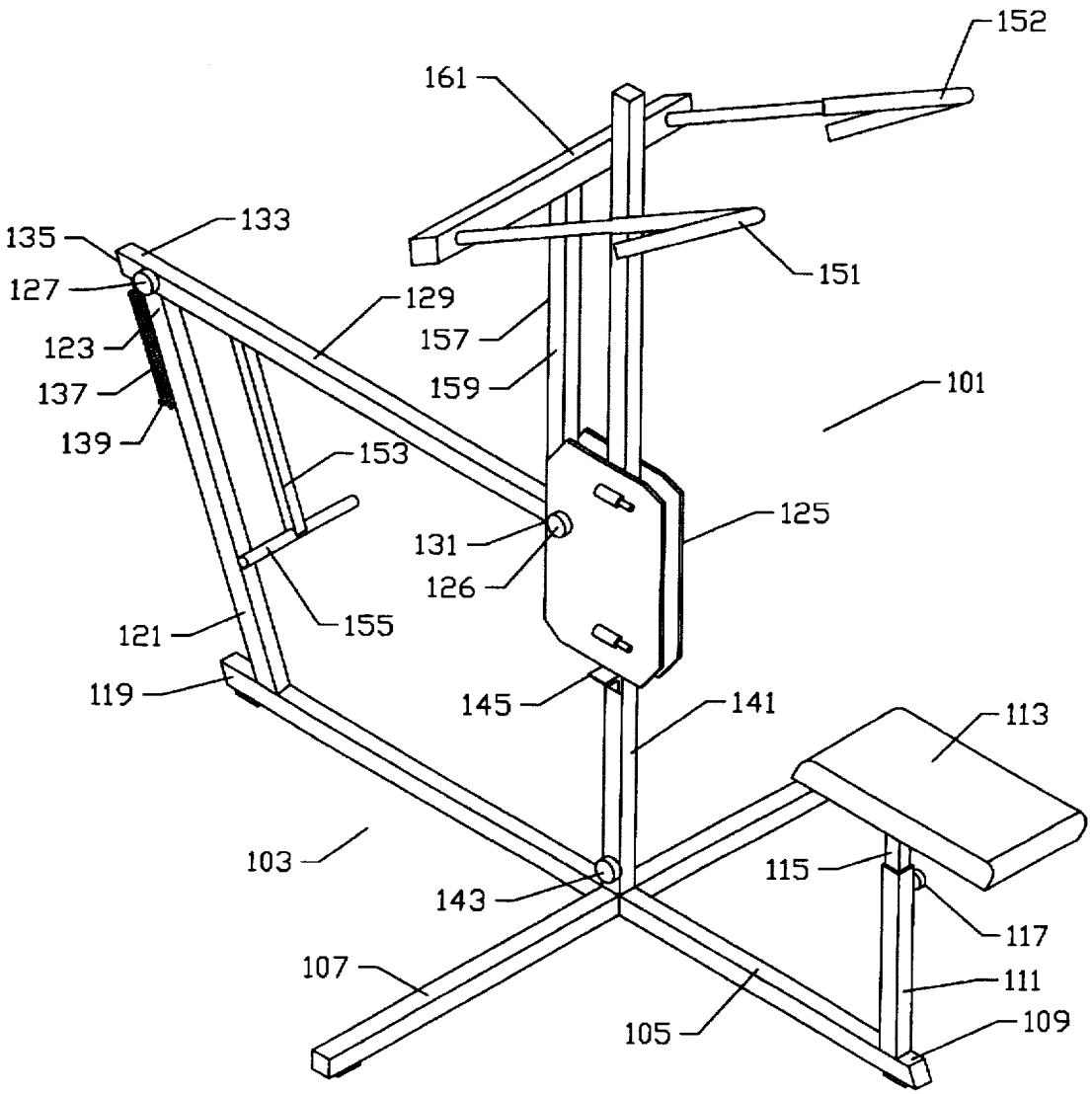
FIG. 6 is a front right perspective .of the upper body exercising embodiment of the invention.
Figure 7:
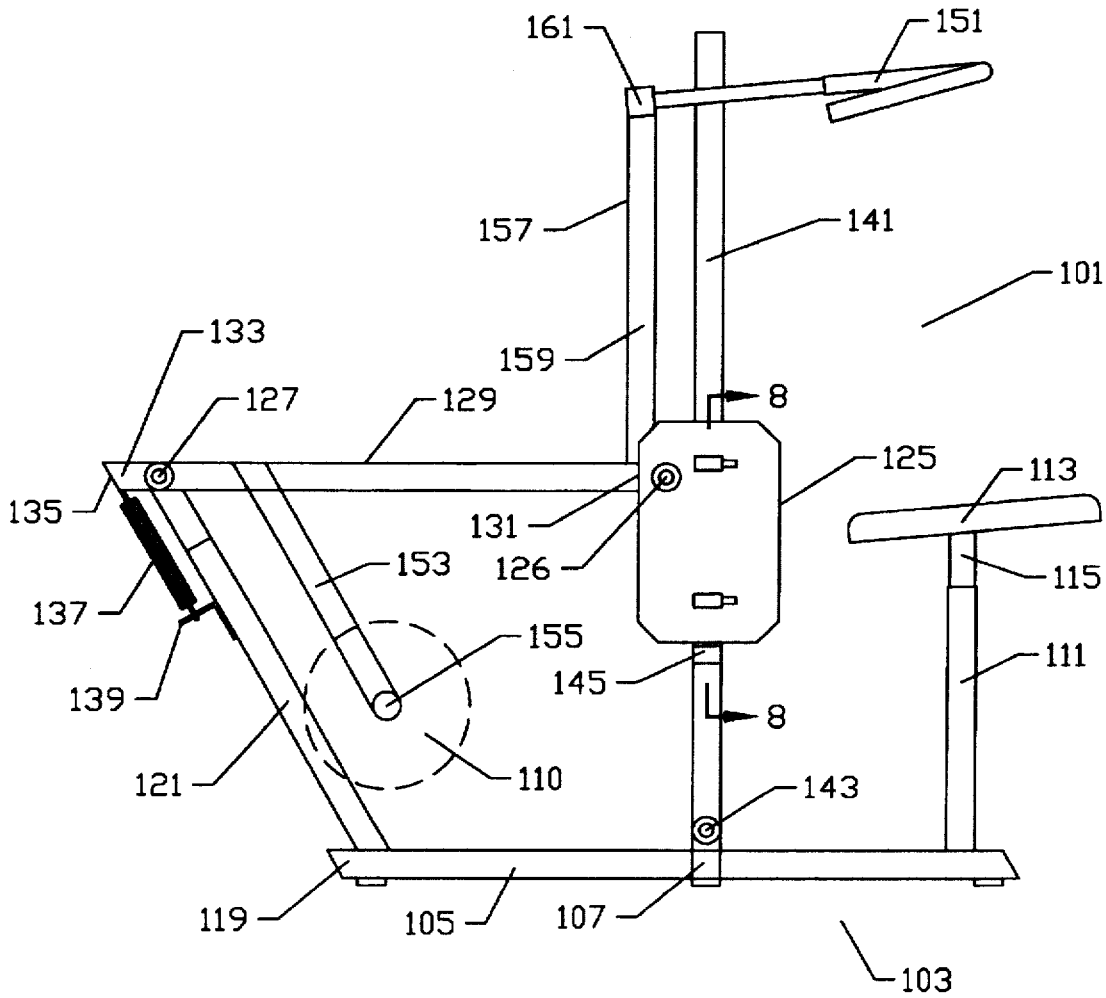
FIG. 7 is a front elevation of the embodiment of the invention shown in FIG. 6.

Referring to FIGS. 6–7, an alternative embodiment preferred for use in exercise of upper body muscles is illustrated.

The upper body exercise apparatus 101 is provided with a base 103 designed to rest on a floor surface. The base 103 comprises an elongate bar 105 having a transverse bar 107 fixed thereto such that base 103 defines a cross. At a first end 109 of elongate bar 105 of base 103 is provided a support member 111 for seat 113. Seat 113 is provided with a mounting pedestal 115 which slidably enters support member 111 such that pedestal 115 may be telescopically adjusted and seat 113 fixed at a selected height by insertion of pin 117 into support member 111 and pedestal 115.

Near second end 119 of elongate bar 105 is fixed an upstanding bar 121 which ascends from elongate bar 105 at an incline. The upper end 123 of upstanding bar 121 is disposed at a point substantially similar in height to the height of seat 113. A pivot arm 129 is pivotally mounted to upstanding bar 121 at the upper end 123 thereof such that pivot arm 129 may be vertically movable. Pivot arm 129 is provided with a head member 125 which is pivotally mounted by pivot axle 126 to first end 131 of pivot arm 129. First end 131 of pivot arm 129 is distal from pivot mount 127 of pivot arm 129 at its connection to upstanding bar 121. Opposing first end 131 of pivot arm 129 is extension 133 of pivot arm 129 which terminates in second end 135 of pivot arm 129. A coil spring 137 links second end 135 of pivot arm 129 to bracket 139 attached to upstanding bar 121. The axis of coil spring 137 is generally parallel to upstanding bar 121. Coil spring 137 is in tension when head member 125 is in a lowered position resting on stop 145 such that pivot arm 129 and head member 125 are generally counterbalanced by the bias of coil spring 137. When head member 125 is raised a few inches, the tension of coil spring 137 is reduced such that the weight of pivot arm 129 is transferred primarily to the user.

Head member 125 is slidable along mast 141 which upstands from a pivot attachment 143 to base 103. In the embodiment illustrated in FIGS. 6 and 7, pivot attachment 143 is located at the intersection of transverse bar 107 with elongate bar 105. Mast 141 is pivotable in the plane defined by the pivotable movement of pivot arm 129. Head member 125 is limited in its lower movement by stop bracket 145 mounted to mast 141.

Head member 125 is provided with handlebars 151,152 which extend from head member 125 to a position above seat 113 such that a user resting on seat 113 may grasp the handlebars 151, 152 with the user's hands positioned above his or her shoulders. The user may then apply upward pressing force to the handlebars 151,152 to raise head member 125 and slide it along mast 141. A weight support arm 153 depends from and below pivot arm 129. The weight support arm 153 is provided with transverse weight mounting bar 155 on which free weights (shown in phantom and identified by the numeral 110) may be placed on either end thereof. Transverse weight mounting bar 155 is fashioned to receive weights which can be mounted to the bar of a barbell. The number and size of weights to be placed on transverse weight mounting bar 155 is selected by the user. Weight support arm 153 is advantageously fixed to pivot arm 129 at an acute angle of 65±5 degrees, with the free end thereof directed toward seat 113.

The handlebars 151, 152 are mounted to head member 125 by means of a T-bar 157 having vertical member 159 which is mounted to head member 125 and extends thereabove to transverse member 161 from the opposing ends of which extend handlebars 151,152. Handlebars 151,152 are curved and elongate to provide comfortable handholds for the user resting on seat 113 and to allow for selective placement of the hands to accommodate varying sizes of users and desired separation of the hands during the exercise movements. The handlebars 151, 152 are spaced apart a comfortable distance to approximate the spacing a weight lifter would use when handling a barbell. Seat 113 may be raised or lowered by selective insertion of pin 117 into holes in pedestal 115 to easily accommodate differing heights of users while free weights may be added to transverse weight mounting arm 155 to the desired loading. Because weight support arm 153 is fixed below pivot arm 129, the raising of head member 125 along mast 141 causes the center of gravity of the weight support arm 153 and any weights mounted to transverse weight mounting arm 155 to move away from pivot mount 127 of pivot arm 129 to upstanding bar 121 and thereby to increase the moment arm of the weights and the resistive force provided by the weights as the head member 125 is raised, thereby creating increasing resistance to arm and shoulder muscles as the arms are extended above the user, while providing reduction of the effective load on the arms of the user when the user's elbows are increasingly bending.

Because of the counterbalance created by coil spring 137, a less powerful user may also get valuable exercise opportunity by raising the unloaded pivot arm 129 along mast 141. As the head member 125 slides upward along mast 141, the tension of spring 137 is relieved and the resistance of the weight of head member 125, pivot arm 129 and weight support arm 155 is increased by the effective increase of the moment created by the weight support arm 153 and its transverse weight mounting bar 155.

Figure 9:
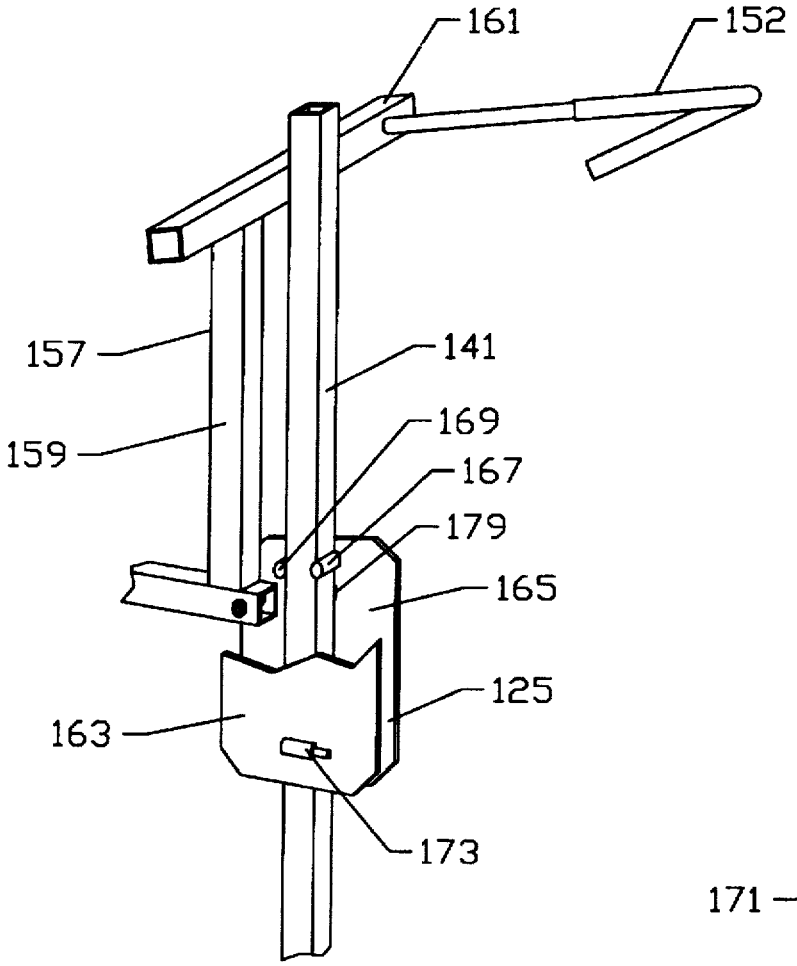
FIG. 9 is a partly cut away perspective view of the head member of the pivot arm of the embodiment of FIG. 6 showing its component parts and their engagement with the mast of the invention embodiment.
Figure 8:
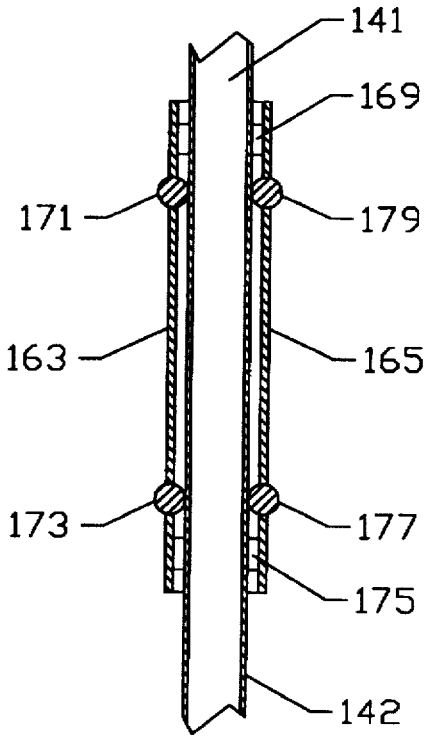
FIG. 8 is a cross section of the mast and head member of the alternate embodiment of the invention taken along line 8—8 of FIG. 7.

Referring now to FIGS. 8 and 9, the detail of the structure of head member 125 can better be visualized. In FIG. 8, the head member 125 and mast 141 are shown in section taken along line 8—8 of FIG. 7. First plate 163 of head member 125 has guide bearings 173 and 171 mounted thereto, which roll along one lateral side of mast 141. Thrust bearings 169 and 175 serve to space first and second plates 163 and 165 and to provide roller bearing upon rear face of mast 141.

FIG. 9 provides a partly cut away front right perspective of the head member 125 and mast 141. Head member 125 comprises first plate 163 and second plate 165 which are maintained in spaced apart relationship on opposing sides of mast 141 by thrust bearings 167 and 169 which roll along the front and rear of mast 141 as head member 125 traverses mast 141. Guide bearings 177 and 179 are mounted within second plate 165 and roll along first side 142 of mast 141.

OPERATION OF THE INVENTION

The invention 2 minimizes the risk of injury because of its unique design which causes the loaded weight of the machine to be distributed correctly to the athlete's body. The weight imposed upon the athlete's frame is mechanically proper for safety and muscle growth and the apparatus utilizes the strength promoting effect of free weights and the safety of a machine. The angled foot plate 10 improves hip and low back mechanics while squatting.

The attachment of the load arm 32 and pivot arm 28 to the fixed upright arm 6 allows for variable resistance as the pivot arm 28 moves up and down. Weight plates loaded on the transverse arm 34 move through a downward arc that decreases the resistance to the user while squatting. This decrease in weight at the bottom allows for perfect form and mechanical advantage when the athlete is in his weakest position. As the athlete returns to the standing position, the weight arcs upward and toward the user. This motion increases the weight and corresponds to the increased leverage of the athlete as he straightens up.

The mast 20 stabilizes the head member 28 and provides the locking holes 66 for the lock plunger 84 to engage when the machine is not in use. This allows the machine to be set at any level depending on the user's height.

The thrust bearing and guide bearings of the head member 38 allow the user and the weight lead to move freely during the up and down movement of the machine. The bearings contact the mast 20 to provide a smooth but tight movement. This structure keeps the plunger 84 aligned with the locking holes 66 in the mast 20. When the lock plunger is engaged in the mast, the head member cannot move. However, by rotating the lock pin the head becomes free to move up or down. To secure the head member 38, the lock handle 86 is rotated back, plunger locates in a mast opening 66, and movement stops. The shoulder thrust pads 42 and 43 rest on the user's shoulders while the user's hands grasp the angled hand grips for balance. The head member transfers the weight lead from the transverse arm 34 to the athlete's shoulders and allows for the required movement. The three pivot points allow the weight rack to arc upward and backward or down and forward without binding the main mast.

The mast latching design allows this machine to be used without the help of a spotter. The variable lead resistance is provided by the angled weight arm 32 on the pivot arm 28. The angled foot plate 10 and the cushioned shoulder pads 42, 43 enhance good and proper form as do the angled hand grips.

With optional toe plate 74 removed, and selected weight plate 110 placed on transverse arm 34, the user 100 takes position on foot plate 10 and unlocks lock 54 to allow the shoulder rests 42, 43 to rest on the user's shoulders. The lock 54 is reset such that the head member is locked to mast 20 at a fixed height. Once comfortable and ready to begin exercise, the user unlocks lock 54 by rotating lock handle 86 which displaces plunger 84 from the opening 66 of mast 20 in which it was resting. The user may then do squatting exercises by thrusting the pelvis rearward and bending the knees, allowing the head member to roll along mast 20 with the force transferred to the user's shoulders at shoulder rests 42 and 43 declining as user lowers his or her torso into the squat position because the weights 110 swing away from the mast 20 as the head member is lowered.

When the bottom of the exercise is reached, the user may thrust the lower body forward and drive the head member 38 up mast 20 while invention 2 increases the resistance as the user approaches a standing position. By moving the feet closer or farther from mast 20 and the shoulder closer or farther from the head member 38, the user may perform varying exercises.

When the optional toe plate 74 is placed upon the foot plate 10, with the head member 38 locked to the mast 10, the user may position his or her feet upon surface 76 with the heels extending from the lower level of toe plate 74 and unsupported. With the lock 54 disengaged, the user may push the shoulder rest 42, 43 upward by action of the feet and ankles in bringing the heels upward to a level even with the balls of the feet which rest on the surface 76.

Exercise of other body structures may be devised with the apparatus as well.

Having described the invention, I claim:

1. Exercise apparatus comprising a base having a first end and a second end, an upstanding bar mounted upon the second end of said base, an upwardly extending mast pivotably mounted to the base between said first and second ends thereof, the upstanding bar having an elongate pivot arm pivotably mounted thereto, the pivot arm pivotable in a vertical plane, said pivot arm having a free end opposing its attachment to said upstanding bar, said free end of said pivot arm provided with a head member engaged with said mast and movable therealong, user engagement means mounted to said head member, said pivot arm having an elongate arm mounted thereto and depending therebeneath, means for suspending weights from said elongate arm, seat means associated with said base.

2. The apparatus of claim 1 wherein said pivot arm has an extension extending from its attachment to said upstanding bar, biasing means urges said extension of said pivot arm toward said base.

3. The apparatus of claim 2 wherein said biasing means counterbalances said head member along said mast when said head member is at a lower position along said mast.

4. The apparatus of claim 2 wherein said biasing means comprises a coil spring in tension.

5. The apparatus of claim 4 wherein said coil spring is interconnected between said extension and said upstanding arm.

6. The apparatus of claim 5 wherein said coil spring has an axis parallel to the axis of said upstanding arm.

7. The apparatus of claim 1 wherein said upstanding bar is disposed to said base at an acute angle.

8. The apparatus of claim 1 wherein the seat means is disposed upon said first end of said base, said user engagement means comprises a pair of spaced apart handlebars disposed generally above said seat means.

9. The apparatus of claim 1 wherein said head member is pivotable upon said pivot arm.

10. The apparatus of claim 1 wherein said head member comprises a pair of spaced apart plates pivotably mounted to said pivot arm, said plates are disposed on opposing sides of said mast, said plates have rollers mounted thereon which engage said mast on opposing sides thereof, said plates are interconnected by a plurality of roller bearings, said roller bearings are engaged with said mast.

11. The apparatus of claim 1 wherein said elongate arm is inclined from said pivot arm at an angle of 65±5 degrees.

12. The apparatus of claim 1 wherein said mast has a stop element therealong, said head member is movable along said mast above said stop element.

13. The apparatus of claim 1 wherein said seat means comprises a seat mounted to a pedestal, said pedestal is mounted to said base.

14. The apparatus of claim 13 wherein said pedestal comprises an elongate sleeve and a slider receivable therein, said slider is selectively attachable to said sleeve at predetermined positions.

15. The apparatus of claim 1 wherein said user engagement means comprises a vertical member upstanding from said head member having a transverse member at the upper end thereof, a pair of spaced apart handlebars extending from said transverse member.

16. The apparatus of claim 1 wherein said pivot arm is moveable in a plane coincident with the axis of said mast and said upstanding bar, said means for suspending weights comprising a transverse bar mounted to said elongate arm depending from said pivot arm.

17. The apparatus of claim 16 wherein said transverse bar receiving free weight plates thereon.

18. Exercise apparatus comprising a base frame having a first end and a second end, an upright bar mounted at the second end of said frame, an upwardly extending mast pivotably mounted to the frame between said first and second ends thereof, the upright bar having an elongate pivot arm pivotably mounted thereto, the pivot arm pivotable in a vertical plane, said pivot arm having a free end opposing its attachment to said upright bar, said free end of said pivot arm provided with a head member engaged with said mast and movable therealong, means for a user to raise said head member, said pivot arm having an elongate arm depending therefrom, said elongate arm depending below said pivot arm.

means for suspending weights from said elongate arm.

19. The apparatus of claim 1 wherein said pivot arm has an extension extending from its attachment to said upstanding bar, biasing means urges said extension of said pivot arm toward said base, seat means is associated with said base frame.

20. The apparatus of claim 19 wherein the seat means is disposed upon said first end of said base frame, said means for a user to raise said head member comprises a pair of spaced apart handlebars fixed to said head member, said handlebars extending from said head member and disposed generally above said seat means, said biasing means comprises a coil spring in tension.

* * * * *